US010319275B2

(12) United States Patent
Jin et al.

(10) Patent No.: US 10,319,275 B2
(45) Date of Patent: Jun. 11, 2019

(54) DISPLAY PANEL AND DISPLAY DEVICE

(71) Applicants: Shanghai AVIC OPTO Electronics Co., Ltd., Shanghai (CN); Tianma Micro-Electronics Co., Ltd., Shenzhen (CN)

(72) Inventors: Huijun Jin, Shanghai (CN); Wantong Shao, Shanghai (CN)

(73) Assignees: Shanghai AVIC OPTO Electronics Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 106 days.

(21) Appl. No.: 15/429,107

(22) Filed: Feb. 9, 2017

(65) Prior Publication Data

US 2017/0162099 A1 Jun. 8, 2017

(30) Foreign Application Priority Data

Jul. 29, 2016 (CN) ..... 2016 1 0615571

(51) Int. Cl.
*G09G 3/20* (2006.01)
*G09G 3/36* (2006.01)

(52) U.S. Cl.
CPC ..... *G09G 3/2003* (2013.01); *G09G 3/3648* (2013.01); *G09G 2300/0426* (2013.01);
(Continued)

(58) Field of Classification Search
CPC ..... G09G 3/2003; G09G 3/3648; G09G 2300/0426; G09G 2300/0452;
(Continued)

(56) References Cited

U.S. PATENT DOCUMENTS

2003/0222315 A1* 12/2003 Amundson ..... G09G 3/344 257/368
2005/0068477 A1* 3/2005 Shin ..... G02F 1/133514 349/106

(Continued)

FOREIGN PATENT DOCUMENTS

CN 1836188 A 9/2006
CN 103885257 A 6/2014

(Continued)

*Primary Examiner* — Mark W Regn
(74) *Attorney, Agent, or Firm* — Kilpatrick Townsend & Stockton LLP

(57) ABSTRACT

The present disclosure provides a display panel and a display device. The display panel includes a plurality of sub-pixels divided into sub-pixels of a first type, sub-pixels of a second type, sub-pixels of a third type and sub-pixels of a fourth type, each type of sub-pixels being configured to display a different color. An area of an aperture region of any of the fourth-sub-pixel type is smaller than an area of an aperture region of each sub-pixel of the first-sub-pixel type, the second-sub-pixel type and the third-sub-pixel type. Each pixel group also includes at least two display elements. Each of the display elements is associated with one of the sub-pixels in the pixel group, and the at least two display elements are disposed within the non-aperture region of the fourth sub-pixel type.

14 Claims, 12 Drawing Sheets

(52) U.S. Cl.
CPC ..... *G09G 2300/0452* (2013.01); *G09G 2300/0465* (2013.01); *G09G 2300/0809* (2013.01); *G09G 2320/0233* (2013.01)

(58) Field of Classification Search
CPC ... G09G 2300/0465; G09G 2300/0809; G09G 2320/0233
USPC ..... 345/88
See application file for complete search history.

(56) References Cited

U.S. PATENT DOCUMENTS

2008/0186325 A1* 8/2008 Higgins ..... G09G 3/2003 345/592
2010/0327285 A1* 12/2010 Yamamoto ..... H01L 21/268 257/59
2012/0091479 A1* 4/2012 Hara ..... G02F 1/1345 257/88

FOREIGN PATENT DOCUMENTS

KR 20110044107 * 4/2011
KR 20110044107 A 4/2011

* cited by examiner

DISPLAY PANEL AND DISPLAY DEVICE

CROSS-REFERENCE TO RELATED APPLICATIONS

The present application is based upon and claims priority to Chinese Patent Application No. 201610615571.5, filed Jul. 29, 2016, the entire contents of which are incorporated herein by reference.

TECHNICAL FIELD

The present disclosure generally relates to the field of display technology, and more particularly, to a display panel and a display device.

BACKGROUND

As shown in FIG. 1, by adding a white color W (or a yellow color Y) sub-pixel to a traditional RGB pixel arrangement constituted by sub-pixels of three kinds of colors (i.e. a red color R, a green color G and a blue color B) and utilizing corresponding sub-pixel rendering technology, a display panel 100 may present an image with sub-pixels of four kinds of colors. Compared with the RGB pixel arrangement of sub-pixels of three kinds of colors, the pixel arrangement of sub-pixels 110 of four kinds of colors can achieve a higher resolution and light transmittance. This is due to the fact that for the pixel arrangement of sub-pixels of four kinds of colors, a back light may be transmitted through white sub-pixels, and cannot be completely obstructed by a dense arrangement of the red sub-pixels R, the green sub-pixels G and the blue sub-pixels B as in the case of the RGB pixel arrangement of sub-pixels of three kinds of colors. Therefore, the light transmittance and brightness of the display panel 100 can be improved.

In addition, for the display panel 100 with sub-pixels 110 of four kinds of colors, during displaying an image of a single color (e.g. a red image, a green image or a blue image), since an aperture ratio of a single color (R/G/B) of the display panel 100 with sub-pixels 110 of four kinds of colors is only ¾ of an aperture ratio of a display panel with sub-pixels of three kinds of colors, there is a problem of low brightness.

SUMMARY

In order to solve the above problems existing in the related art, the present disclosure provides a display panel and a display device which can improve the display effect.

According to one aspect of the present disclosure, there is provided a display panel, includes a plurality of sub-pixels formed by a plurality of scan lines intersecting a plurality of data lines. The plurality of sub-pixels forms a rectangular arrangement, each of the sub-pixels including a pixel electrode. The plurality of sub-pixels are divided into sub-pixels of a first type, sub-pixels of a second type, sub-pixels of a third type and sub-pixels of a fourth type. Each type of the sub-pixels are configured to display a different color, wherein, each sub-pixel of the first-type, each sub-pixel of the second type, each sub-pixel of the third type and each sub-pixel of the fourth-type include an aperture region and a non-aperture region; an area of an aperture region of each of the fourth-type sub-pixels is smaller than an area of an aperture region of any sub-pixel of the first-type, the second-type and the third-type. The plurality of sub-pixels are divided into a plurality of pixel groups. Each of the pixel groups includes four of the sub-pixels, one of the four sub-pixels in each of the pixel groups is one of the fourth-type sub-pixels, each of the pixel groups includes at least two display elements, each of the display elements is associated with one of the sub-pixels in the pixel group, and the at least two display elements are disposed within the non-aperture region of the fourth-type sub-pixel. The display panel and the display device provided by the present disclosure may improve the display effect.

According to another aspect of the present disclosure, there is provided a display device including the display panel as described above.

Compared with the related art, in the present disclosure, by making the area of the aperture region of the fourth-type sub-pixel smaller than the area of the aperture region of any sub-pixel of other types, the problem of redundant brightness for the fourth-type sub-pixel may be mitigated. Moreover, in the present disclosure, at least two display elements are disposed within the non-aperture region of the fourth-type sub-pixel to further increase the area of the aperture region of one sub-pixel of the first-type sub-pixels, the sub-pixel of the second sub-pixel types and the sub-pixel of the third sub-pixel types, and the brightness of an image displayed by the first (the second or the third) sub-pixels may be improved.

BRIEF DESCRIPTION OF THE DRAWINGS

The above and other characteristics and advantages of the present disclosure will become apparent from the exemplary embodiments with reference to the accompanying drawings.

DETAILED DESCRIPTION

Exemplary embodiments will now be more fully described with reference to the accompanying drawings. However, the exemplary embodiments can be implemented in various forms, and should not be understood as limited to the embodiments set forth herein. On the contrary, these embodiments are provided to make the present disclosure thorough and complete, and to fully convey the concept of the exemplary embodiments to those skilled in the art. Similar numeral references denote similar or same parts throughout the accompanying drawings, and repeat description thereof will be omitted.

In addition, the features, structures or characteristics described herein can be combined in one or more embodiments in any appropriate way. In the description herein, many specific details are provided for fully understanding of the embodiments in accordance with the present disclosure. However, it will be appreciated by those skilled in the art that the technical solution of the present disclosure can be practiced without one or more of the specific details, or with other methods, components, devices or steps, etc. In addition, known structures, methods, devices, implementations, materials or operations will not be illustrated or described in detail, to avoid obscuration of the aspects of the present disclosure.

The accompanying drawings of the present disclosure only show a relative positional relationship, and the sizes of the elements in the accompanying drawings do not represent the proportional relationship of the actual sizes.

In order to solve a display problem in the related art, the present disclosure provides a display panel and a display device. The display panel includes a plurality of sub-pixels formed by a plurality of scan lines intersecting a plurality of data lines. The plurality of sub-pixels are arranged in a matrix. Each sub-pixel includes a pixel electrode. The plurality of sub-pixels are divided into sub-pixels of a first type, sub-pixels of a second type, sub-pixels of a third type and sub-pixels of a fourth type. Each type of sub-pixels are configured to display a different color. For the sub-pixel of the first type, the sub-pixel of the second type, the sub-pixel of the third type and the sub-pixel of the fourth type, each has an aperture region and a non-aperture region. An aperture region of each sub-pixel of the fourth type has an area smaller than an area of an aperture region of any sub-pixel of the first type, the second type, and the third type. The plurality of sub-pixels are divided into a plurality of pixel groups. Each pixel group contains four sub-pixels, and one of the four sub-pixels is a sub-pixel of the fourth type. Each pixel group also includes at least two display elements. Each of the two display elements is associated with one of the four sub-pixels and the at least two display elements are disposed in the non-aperture region of the fourth-type sub-pixel.

Figure 1:
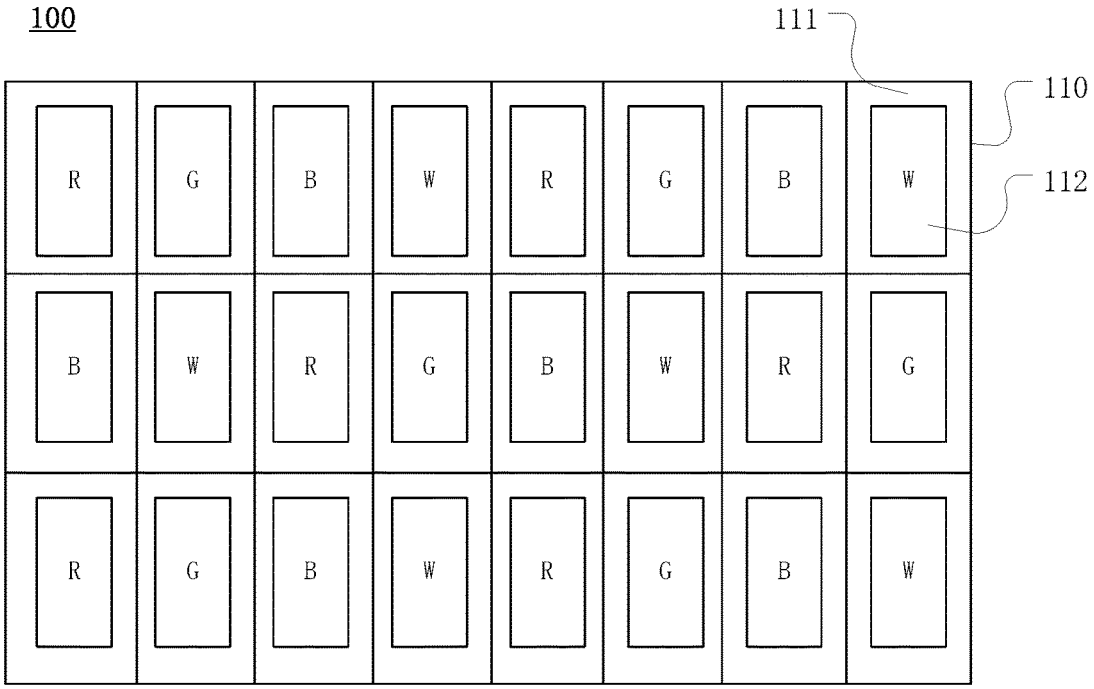
FIG. 1 is a schematic diagram illustrating a display panel in the related art.
Figure 2:
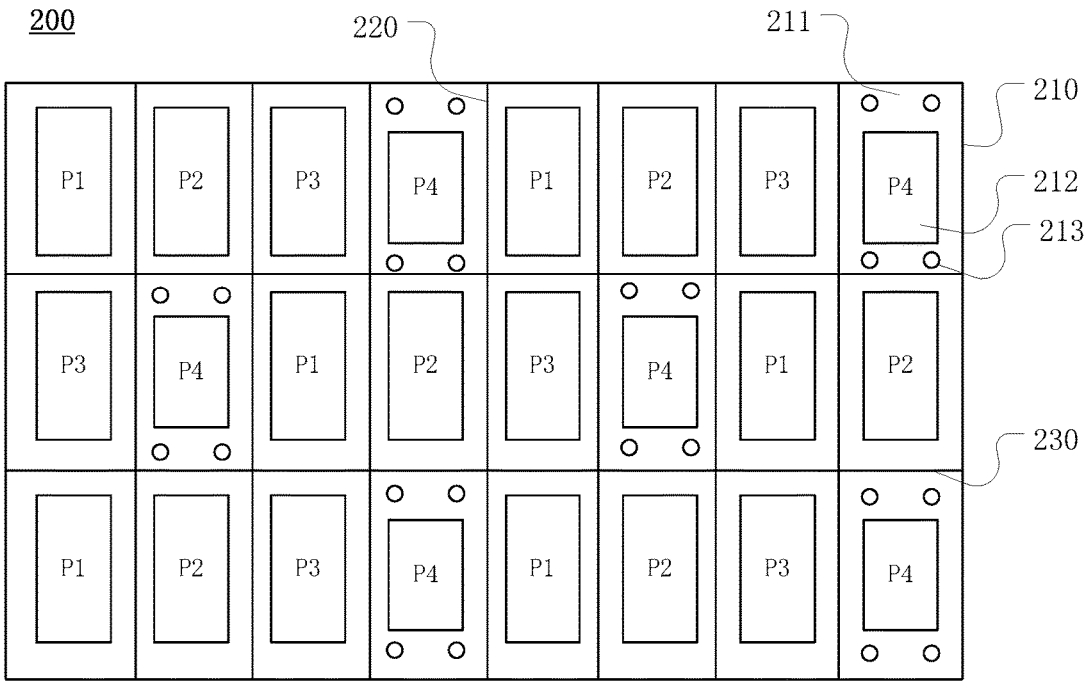
FIG. 2 is a schematic diagram illustrating a display panel according to an embodiment in accordance with the disclosure.

Now, a display panel provided by the present disclosure will be described with reference to FIG. 2, and FIG. 2 is a schematic diagram illustrating a display panel 200 according to an embodiment in accordance with the disclosure.

The display panel 200 includes a plurality of sub-pixels 210 formed by a plurality of scan lines 230 intersecting a plurality of data lines 220. The sub-pixels 210 are arranged in a matrix. Each sub-pixel 210 includes a pixel electrode. The plurality of sub-pixels 210 are divided into sub-pixels of a first type P1, sub-pixels of a second type P2, sub-pixels of a third type P3 and sub-pixels of a fourth type P4. Each type of sub-pixels are configured to display a different color. Optionally, the first type sub-pixels P1, the second type sub-pixels P2 and the third type sub-pixels P3 are respectively one distinct type of red sub-pixels, green sub-pixels and blue sub-pixels. Optionally, the fourth-type sub-pixels P4 are white sub-pixels or yellow sub-pixels. Optionally, each sub-pixel 210 has a width-length ratio of 1:3.

Specifically, in the matrix of the plurality of sub-pixels 210, the fourth-type sub-pixels P4 are disposed as spaced apart from one another by one or more sub-pixels of other types in a row direction and in a column direction. In other words, any two of the fourth-type sub-pixels P4 are not adjacent to each other in the row direction or in the column direction. Between any two closest fourth-type sub-pixels P4 in the row direction or in the column direction there may be one or more sub-pixels of a type (i.e. the first, second or third type) other than the fourth type.

In the embodiment as shown in FIG. 2, in a row of the matrix of the plurality of sub-pixels 210, one sub-pixel of the first-type P1, one sub-pixel of the second type P2, one sub-pixel of the third type P3 and one sub-pixel P4 of the fourth type are arranged alternately in an order as shown. Sub-pixels of the same type in two adjacent rows are misaligned with each other by two sub-pixels 210. For example, a first-type sub-pixel P1 in a first row is aligned with a sub-pixel of the third sub-pixel type P3 in a second row. In the column direction, a sub-pixel of a type in a row is aligned with a sub-pixel of the same type in a second row from the former row. For example, a first-type sub-pixel P1 in a first row is aligned with another first-type sub-pixel P1 in a third row. FIG. 2 only illustrates an exemplary arrangement of the sub-pixels according to the present disclosure. The number of the sub-pixels, the number of the rows or the columns and the shapes of each sub-pixel are not limited thereto, and various other arrangements of sub-pixels may be contemplated by one skilled in the art, which will not be elaborated herein.

Specifically, each of the first-type sub-pixels P1, the sub-pixel of the second sub-pixel types P2, the sub-pixel of the third sub-pixel types P3 and the fourth-type sub-pixels P4 has an aperture region 212 and a non-aperture region 211. The aperture region 212 of each sub-pixel of the fourth sub-pixel type P4 has an area smaller than an area of an aperture region of any of the first-type sub-pixel P1, the sub-pixel of the second sub-pixel type P2 and the sub-pixel of the third sub-pixel type P3. In this embodiment, the first-type sub-pixels P1, the sub-pixel of the second sub-pixel types P2 and the sub-pixel of the third sub-pixel types P3 are shown as each has an aperture region of the same area. In other words, in this embodiment, the aperture region 212 of each sub-pixel of the fourth sub-pixel type P4 has an area smaller than the area of the aperture region of each of the first-type sub-pixels P1, the sub-pixel of the second sub-pixel types P2 and the sub-pixel of the third sub-pixel types P3. Optionally, the area of the aperture region of each sub-pixel of the fourth sub-pixel type P4 may be larger than or equal to one third of an average area of the aperture regions of one first-type sub-pixel P1, one sub-pixel of the second sub-pixel type P2 and one sub-pixel of the third sub-pixel type P3, in order to achieve a higher resolution in rendering the sub-pixels for imaging.

Specifically, in the present disclosure, by making the area of the aperture region 212 of each sub-pixel of the fourth sub-pixel type P4 smaller than the area of the aperture region 212 of each sub-pixel of other types, the problem of redundant brightness for the fourth-type sub-pixels P4 may be mitigated.

Further, the plurality of sub-pixels 210 are divided into a plurality of pixel groups. Each pixel group includes four sub-pixels 210. In the embodiment, one of the four sub-pixels 210 in each pixel group is a sub-pixel of the fourth sub-pixel type P4. In one embodiment, each pixel group may include one first-type sub-pixel P1, one sub-pixel of the second sub-pixel type P2, one sub-pixel of the third sub-pixel type P3 and one sub-pixel of the fourth sub-pixel type P4. In another embodiment, each pixel group may include one first-type sub-pixel P1 (or one sub-pixel of the third sub-pixel type P3), two sub-pixel of the second sub-pixel types P2 and one sub-pixel of the fourth sub-pixel type P4.

The arrangement of the sub-pixels in each pixel group will be described with reference to other accompanying drawings. Each pixel group also includes at least two display elements 213, and each of the display elements 213 is associated with one sub-pixel 210. In the embodiment as shown in FIG. 2, four display elements 213 are disposed in each pixel group. In other words, the at least two display elements 213 in each pixel group may respectively correspond to the four sub-pixels 210 in the pixel group. In another embodiment, the four display elements 213 in each pixel group may be associated with only one sub-pixel 210. The at least two display elements 213 in each pixel group are disposed in the non-aperture region of the sub-pixel of the fourth sub-pixel type P4. For example, in this embodiment, the four display elements 213 in each pixel group may be disposed in the non-aperture region 211 of the sub-pixel of the fourth sub-pixel type P4.

Accordingly, in the present disclosure, the at least two display elements 213 in each pixel group are disposed in the non-aperture region 211 of the sub-pixel of the fourth sub-pixel type P4, such that an area of an aperture region 212 of a sub-pixel of other types may be increased compared with the related art, and thus the aperture ratio of a sub-pixel of other types may be increased. Therefore, it can mitigate the problem that the brightness is undesirably low when the display panel 200 displays a single color (the color of the first-type sub-pixels/the sub-pixel of the second sub-pixel types/the sub-pixel of the third sub-pixel types).

Now, the specific configuration of the display elements will be described in connection with some embodiments of the present disclosure.

Figure 3:
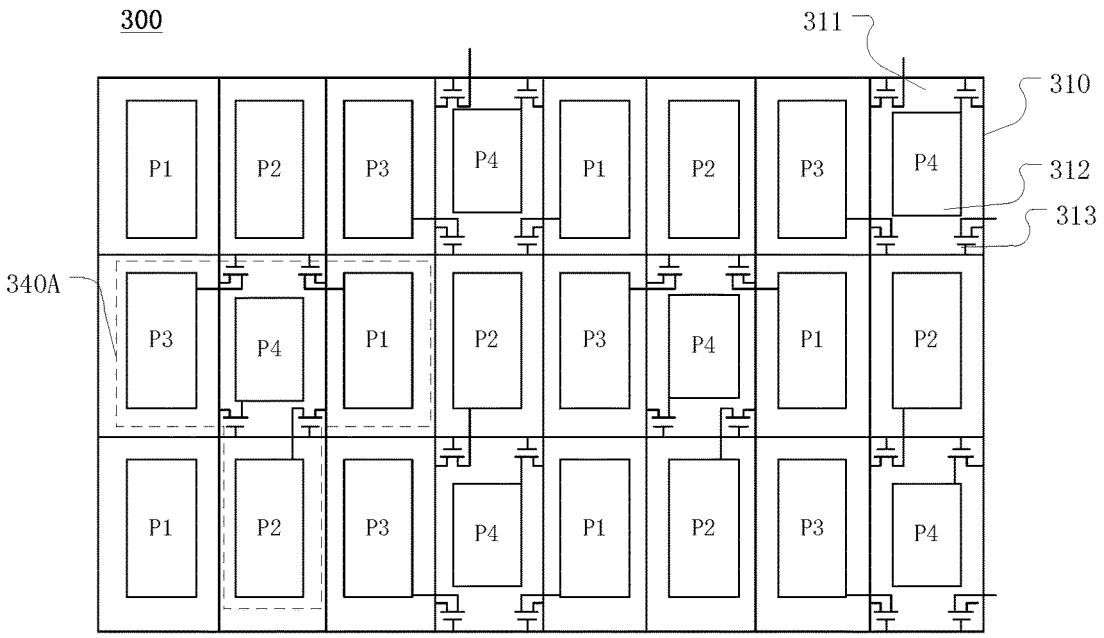
FIG. 3 is a schematic diagram illustrating a display panel according to an embodiment in accordance with the disclosure.

Firstly referring to FIG. 3, which illustrates a display panel 300 according to an embodiment in accordance with the disclosure. The configuration of the display panel 300 as shown in FIG. 3 is similar to that of the display panel 200 as shown in FIG. 2. In the embodiment, the display panel 300 will be described by taking one pixel group 340A as an example. The pixel group 340A includes one first-type sub-pixel P1, one sub-pixel of the second sub-pixel type P2, one sub-pixel of the third sub-pixel type P3 and one sub-pixel of the fourth sub-pixel type P4. In the pixel group 340A, the sub-pixels are arranged in a "T" shape, with the first-type sub-pixel P1, the sub-pixel of the second sub-pixel type P2 and the sub-pixel of the third sub-pixel type P3 surrounding the sub-pixel of the fourth sub-pixel type P4. In the pixel group 340A, four display elements 313 are disposed in a non-aperture region 311 of the sub-pixel of the fourth sub-pixel type P4. Each of the display elements 313 is a thin film transistor having a gate electrode, a source electrode and a drain electrode. The drain electrodes of the four display elements 313 are electrically connected to the pixel electrodes of the four sub-pixels 310 in the pixel group 340A respectively.

Specifically, in the embodiment as shown in FIG. 3, the gate electrodes and the source electrodes of the four thin film transistors in the pixel group 340A are respectively connected to various combinations of scan lines and data lines. The drain electrodes of the four thin film transistors are respectively connected to the pixel electrode of the sub-pixel of the fourth sub-pixel type P4, the pixel electrodes of two sub-pixels (for example a P3 and a P1) adjacent to the sub-pixel of the fourth sub-pixel type P4 in the row direction of the rectangle and one sub-pixel (for example a P2) adjacent to the sub-pixel of the fourth sub-pixel type P4 in the column direction of the matrix. In this way, the four sub-pixels in the pixel group 340A may be arranged in a "T" shape.

For the sake of visual brevity, FIG. 3 only shows the electrical connection of the thin film transistor 313 in the pixel group 340A. Electrical connection between the sub-pixels and the film transistors 313 in other pixel groups may be implemented by one skilled in the art according to the description regarding the pixel group 340A. For example, the four sub-pixels in one of the other pixel groups may be arranged in a "T" shape (or an inverse "T" shape), and the electrical connection between the four sub-pixels and the four thin film transistors 313 is similar to that of the pixel group 340A. The details will not be repeated herein.

Figure 4:
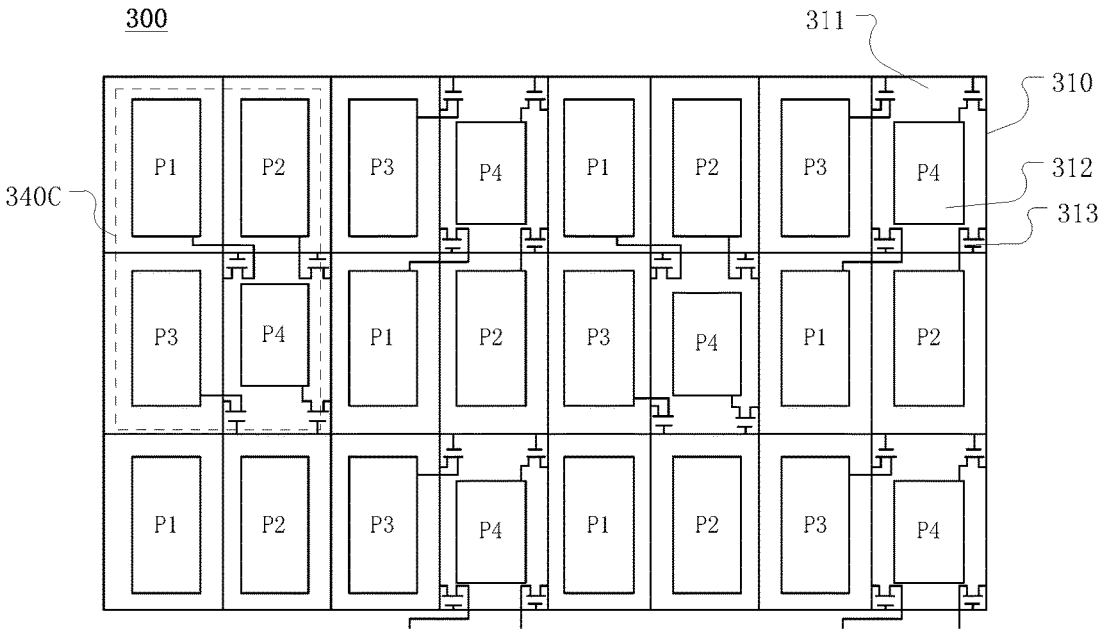
FIG. 4 is a schematic diagram illustrating a display panel according to an embodiment in accordance with the disclosure.

Referring to FIG. 4, which illustrates a display panel 300 according to an embodiment in accordance with the disclosure. The configuration of the display panel 300 as shown in FIG. 4 is similar to that of the display panel 300 as shown in FIG. 3, except for the connection between the four sub-pixels 310 and the thin film transistor 313 in a pixel group 340C. In the embodiment shown in FIG. 4, the gate electrodes and the source electrodes of the four thin film transistors 313 in a pixel group 340C are respectively connected to various combinations of scan lines and data lines. The drain electrodes of the four thin film transistors 313 are respectively connected to the pixel electrode of the sub-pixel of the fourth sub-pixel type P4, the pixel electrode of one sub-pixel (for example a P2) adjacent to the sub-pixel of the fourth sub-pixel type P4 in the column direction of the matrix, the pixel electrode of one sub-pixel (for example a P3) adjacent to the sub-pixel of the fourth sub-pixel type P4 in the row direction of the matrix and the pixel electrode of one sub-pixel (for example a P1) adjacent to the above sub-pixels except for the sub-pixel of the fourth sub-pixel type P4. In this way, the four thin film transistors 313 correspond to the four sub-pixels, and the four sub-pixels in the pixel group 340C may be arranged in a 2*2 matrix.

For the sake of visual brevity, FIG. 4 only shows the electrical connection of the thin film transistor 313 in the pixel group 340C. Electrical connection between the sub-pixels and the film transistors 313 in other pixel groups may be implemented by one skilled in the art according to the description regarding the pixel group 340C.

In the embodiments as shown in FIGS. 3 and 4, the four thin film transistors 313 electrically connecting to the four sub-pixels in the pixel group are disposed in the non-aperture region of the sub-pixel of the fourth sub-pixel type P4, such that an area of an aperture region 312 of a sub-pixel of other types may be increased compared with the related art, and thus the aperture ratio of a sub-pixel of other types may be increased.

Figure 5:
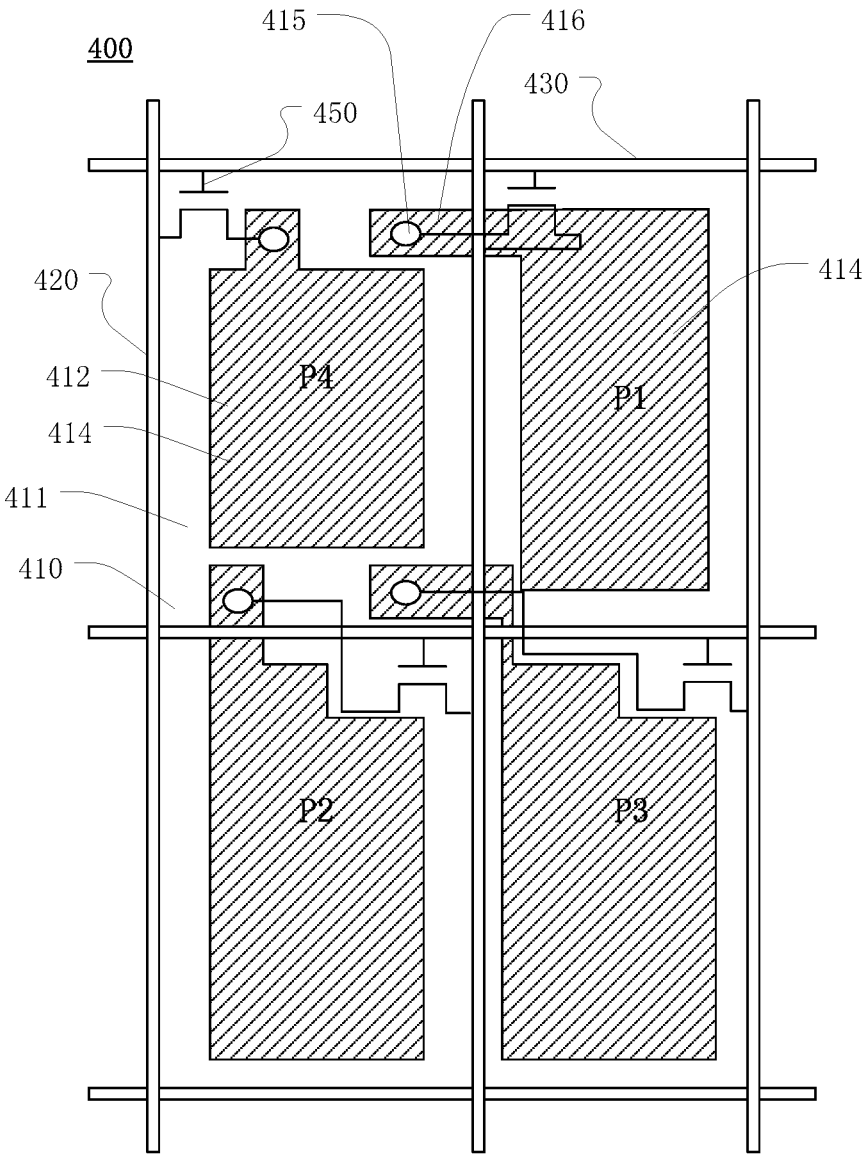
FIG. 5 is a schematic diagram illustrating a display panel according to an embodiment in accordance with the disclosure.

Now, a display panel 400 according to an embodiment in accordance with the disclosure will be described with reference to FIGS. 5 and 6. The configuration of the display panel 400 as shown in FIG. 5 is similar to the display panel 200 as shown in FIG. 2. Specifically, in this embodiment, the display element 413 is a pixel-electrode via hole. The pixel-electrode via hole 413 is an electrical connection configuration for connecting a pixel electrode of a pixel and a drain electrode.

FIG. 5 only shows configuration of one pixel group. The pixel group includes one first-type sub-pixel P1, one sub-pixel of the second sub-pixel type P2, one sub-pixel of the third sub-pixel type P3 and one sub-pixel of the fourth sub-pixel type P4. In the pixel group, the sub-pixels are arranged in a 2*2 matrix. The sub-pixels 410 are surrounded by a plurality of scan lines 430 intersecting a plurality of data lines 420.

In this embodiment, the pixel group includes four thin film transistors 450. The drain electrodes of the four thin film transistors 450 are electrically connected through the pixel-electrode via holes 413 to the pixel electrodes 414 of the four sub-pixels 410 in the pixel group respectively, and in turn associating the pixel-electrode via holes 413 respectively with the four sub-pixels. The source electrodes of the four thin film transistors 450 are electrically connected to the data lines 420. The gate electrodes of the four thin film transistors 450 are electrically connected to the scan lines 430. The four thin film transistors are respectively disposed within the four sub-pixels, and the four pixel-electrode through holes 413 are disposed within the non-aperture region 411 of the sub-pixel of the fourth sub-pixel type P4. Further, in this embodiment, an extending segment 416 of the pixel electrode 414 of each sub-pixel 410 extends into the non-aperture region 411 of the sub-pixel of the fourth sub-pixel type P4. For each pixel electrode, the pixel-electrode through hole 413 is disposed on the extending segment 416 of the pixel electrode 414. Optionally, the extending segment 416 is a transparent electrode in the same layer with the corresponding pixel electrode 414 and connected with the corresponding pixel electrode 414. For example, the extending segment 416 may be a transparent electrode made of ITO material.

FIG. 5 only shows the pixel group with sub-pixels arranged in a 2*2 matrix. The present disclosure is not limited thereto, and one skilled in the art may contemplate an embodiment in which the sub-pixels are disposed in a "T" shaped arrangement, and the four pixel-electrode through holes 413 are disposed in the non-aperture region 411, which will not be elaborated herein.

In addition, a stacked configuration of the display panel 400 is described with reference to FIG. 6. For the sake of visual brevity, FIG. 6 only illustrates the positional relationship of the layers of the display panel 400 in a cross sectional view which does not correspond to the plane view of the display panel 400 as shown in FIG. 5.

Figure 6:
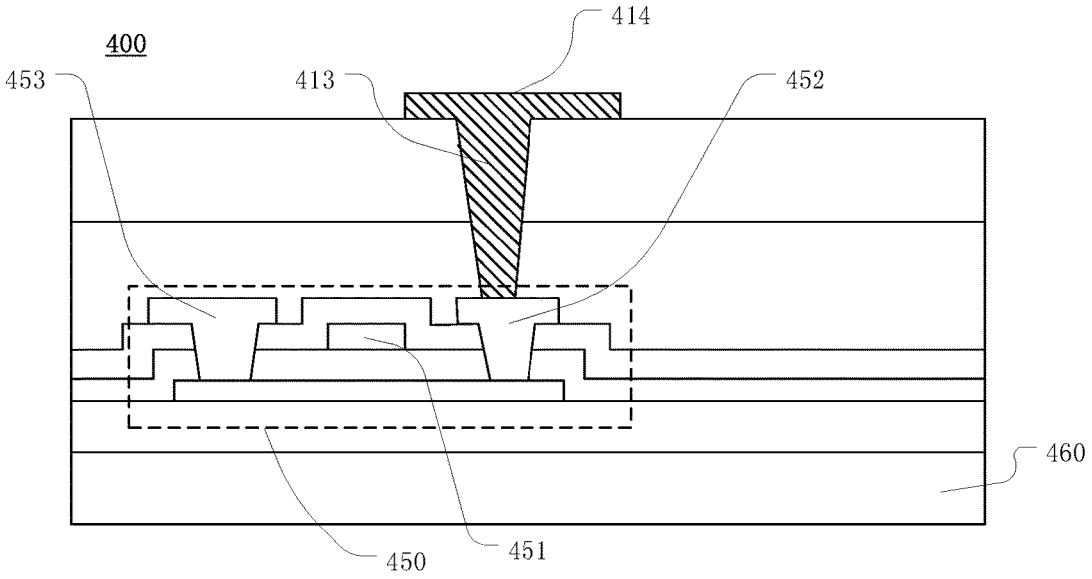
FIG. 6 is a cross sectional view of a display panel according to an embodiment in accordance with the disclosure.

As shown in FIG. 6, the display panel 400 includes a substrate 460, a thin film transistor 450 over the substrate 460 and a pixel electrode 414 over the thin film transistor 450. The thin film transistor 450 includes an active layer, and a gat electrode 451, a drain electrode 452 and a source electrode 453 over the active layer. The display panel 400 also includes thereon a scan line (not shown) on the same layer with the gate electrode 451 and electrically connected with the gate electrode 451, and a data line (not shown) on the same layer with the drain electrode 452 and the source electrode 453 and electrically connected with the source electrode 453. The pixel electrode 414 is electrically connected to the drain electrode 452 through the pixel-electrode via hole 413.

FIG. 6 only shows the configuration of the thin film transistor 450. One skilled in the art can also implement a thin film transistor 450 of other types. Optionally, the display panel 400 may also include a common electrode between the pixel electrode 414 and the source electrode, the drain electrode of the thin film transistor 450, which will not be elaborated herein.

In the embodiment as shown in FIGS. 5 and 6, the four pixel-electrode through holes 413 associated with the four sub-pixels in the pixel group are disposed in the non-aperture region 411 of the fourth-type sub-pixel, such that an area of an aperture region 412 of a sub-pixel of other types may be increased compared with the related art, and thus the aperture ratio of a sub-pixel of other types may be increased.

Figure 7:
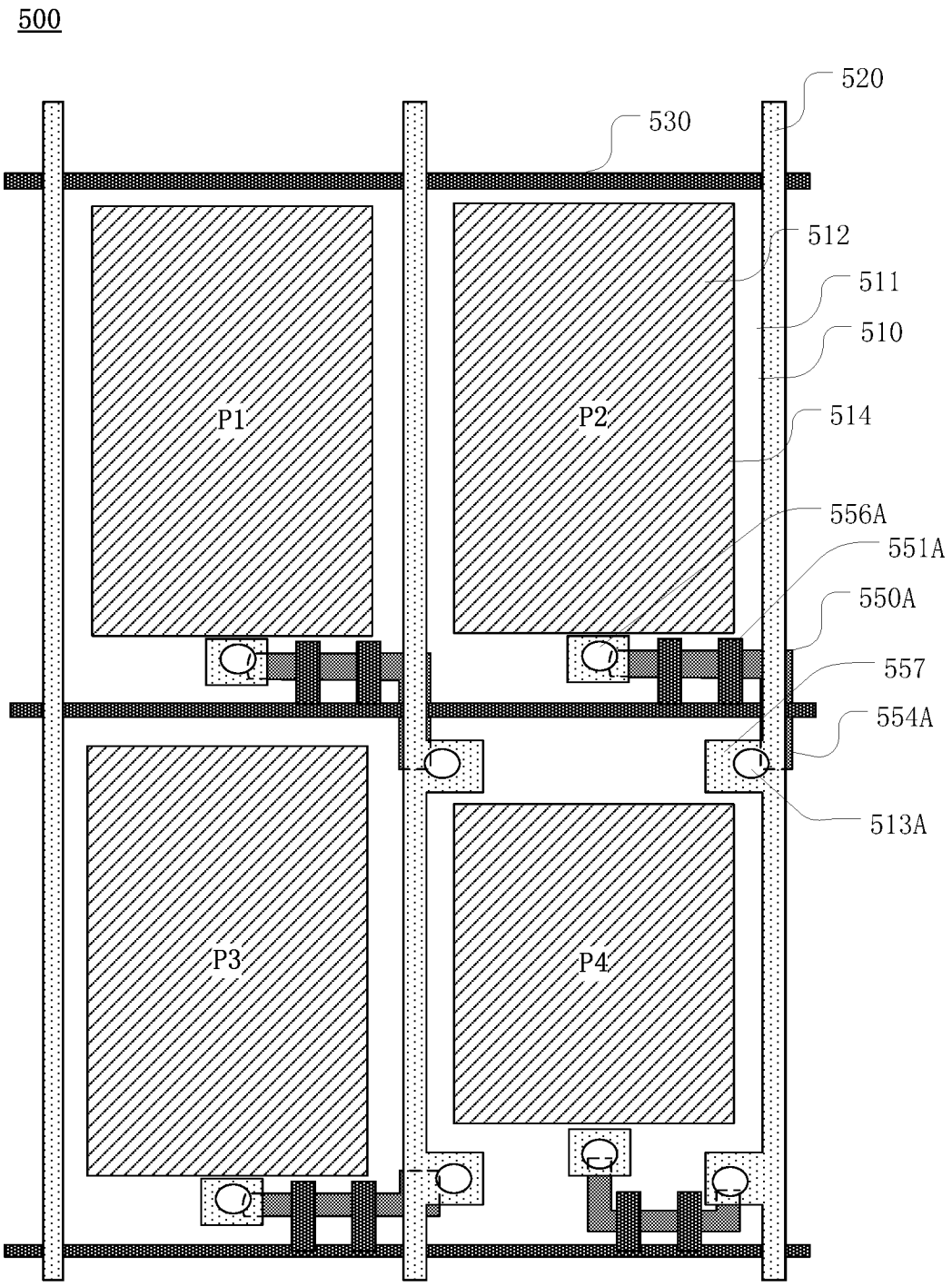
FIG. 7 is a schematic diagram illustrating a display panel according to an embodiment in accordance with the disclosure.

FIG. 7 illustrates a display panel 500 according to an embodiment in accordance with the disclosure. The configuration of the display panel 500 as shown in FIG. 7 is similar to the display panel 200 as shown in FIG. 2. Specifically, in this embodiment, there are four display elements 513A and each display elements 513A is a data-line leading hole. A pixel electrode 514 of each sub-pixel 510 in the pixel group is electrically connected to a drain electrode 556A of a thin film transistor 550A. A source electrode 555A of the thin film transistor 550A is electrically connected to one data line 520 through one data-line leading hole 513A. Four display elements 513A are disposed in the non-aperture region 511 of the sub-pixel of the fourth sub-pixel type P4.

FIG. 7 only shows the configuration of one pixel group. The pixel group includes one first-type sub-pixel P1, one sub-pixel of the second sub-pixel type P2, one sub-pixel of the third sub-pixel type P3 and one sub-pixel of the fourth sub-pixel type P4. In the pixel group, the sub-pixels are arranged in a 2*2 matrix. The sub-pixels 510 are surrounded by a plurality of scan lines 530 intersecting a plurality of data lines 520.

In this embodiment, the pixel group includes four thin film transistors 550A. The drain electrodes 556A of the four thin film transistors 550A are electrically connected via through holes to the active layers. The source electrodes 555A of the four thin film transistors 550A are respectively connected through the four data-line leading holes 513A to the active layers 554A of the thin film transistors 550A, such that the four thin film transistors 550A are electrically connected to the four sub-pixels 510 respectively, and the data-line leading holes 513A are associated with the four sub-pixels 510 in the pixel group. The gate electrodes 551A of the four thin film transistors 550A are electrically connected to the scan lines 530. In this embodiment, the gate electrode 551A of each thin film transistor 550A is double "I" shaped, and the channel of the semiconductor of each thin film transistor 550A is also "I" shaped.

The four data-line leading holes 513A are disposed within the non-aperture region 511 of the sub-pixel of the fourth sub-pixel type P4. In addition, in this embodiment, two data lines 520 which are adjacent to the sub-pixel of the fourth sub-pixel type P4 each has four protrusions 557 toward the pixel electrode of the sub-pixel of the fourth sub-pixel type P4 within the non-aperture region 511 of the sub-pixel of the fourth sub-pixel type P4, as the source electrodes 555A of the thin film transistors 550A. The four protrusions 557 are connected to the active layers 554A of the thin film transistors 550A through the data-line leading holes 513A.

FIG. 7 only shows the pixel group with sub-pixels arranged in a 2*2 matrix. The present disclosure is not limited thereto, and one skilled in the art may contemplate an embodiment in which the sub-pixels are disposed in a "T" shaped arrangement, and the four data-line leading holes 513A are disposed in the non-aperture region 511, which will not be elaborated herein. In addition, the thin film transistor as shown in FIG. 7 is a double gate configuration. However, the present disclosure is not limited thereto, and the thin film transistor may also be a single gate configuration.

Figure 8:
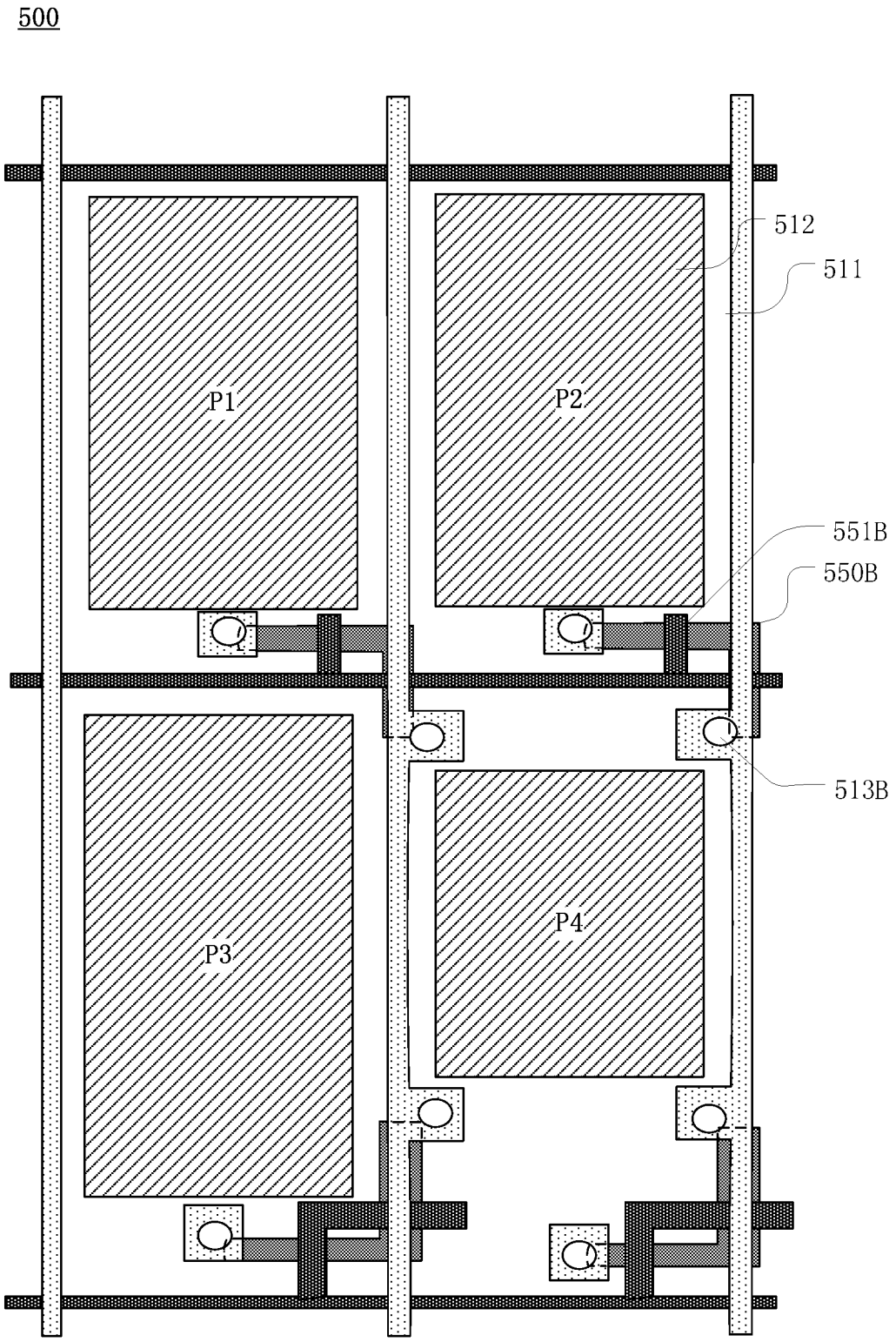
FIG. 8 is a schematic diagram illustrating a display panel according to an embodiment in accordance with the disclosure.

FIG. 8 is a schematic diagram illustrating a display panel 500 according to an embodiment in accordance with the disclosure. The configuration of the display panel 500 as shown in FIG. 8 is similar to the display panel as shown in FIG. 7. Specifically, in this embodiment, there are four display elements 513B and each display elements 513B is a data-line leading hole. The four data-line leading holes 513B are disposed within the non-aperture region 511 of the sub-pixel of the fourth sub-pixel type P4.

In this embodiment, the gate 551B of the thin film transistor 550B may be "I" shaped and/or "L" shaped. Optionally, in one pixel group, the gate electrodes 551B of two thin film transistors 550B in the same row have the same shape, and the gate electrodes 551B of two thin film transistors 550B in the same column have different shapes.

Figure 9:
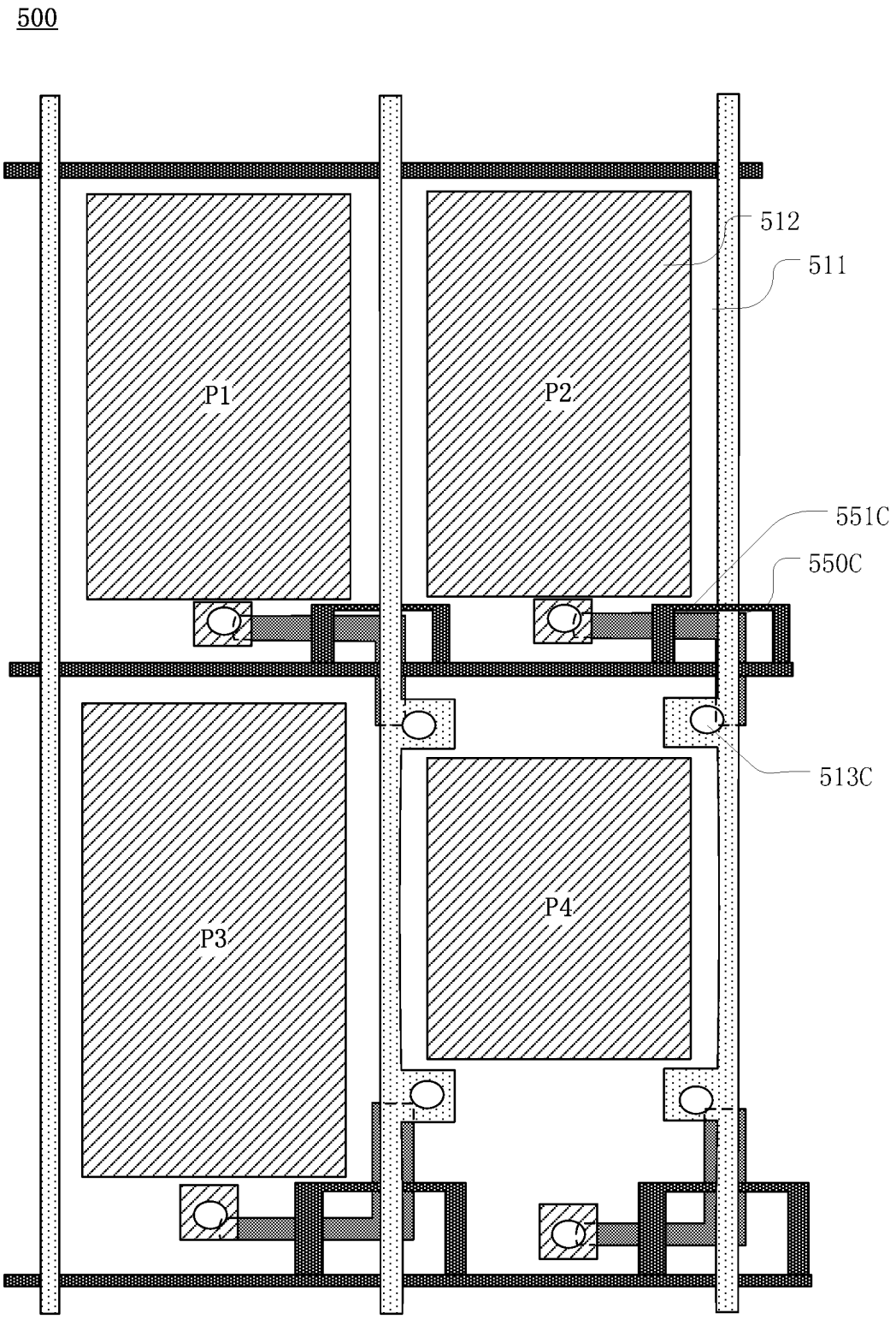
FIG. 9 is a schematic diagram illustrating a display panel according to an embodiment in accordance with the disclosure.

FIG. 9 is a schematic diagram illustrating a display panel 500 according to an embodiment in accordance with the disclosure. The configuration of the display panel 500 as shown in FIG. 9 is similar to the display panel as shown in FIG. 7. Specifically, in this embodiment, there are four display elements 513C and each display elements 513C is a data-line leading hole. The four data-line leading holes 513C are disposed within the non-aperture region 511 of the sub-pixel of the fourth sub-pixel type P4. In this embodiment, the gate electrode 551C of the thin film transistor 550C may be in a hollow squared shape.

In the embodiments as shown in FIGS. 7 to 9, the four data-line leading holes associated with the four sub-pixels in the pixel group are disposed within the non-aperture region 511 of the sub-pixel of the fourth sub-pixel type P4, such that an area of an aperture region 512 of a sub-pixel of other types may be increased compared with the related art, and thus the aperture ratio of a sub-pixel of other types may be increased.

Figure 10:
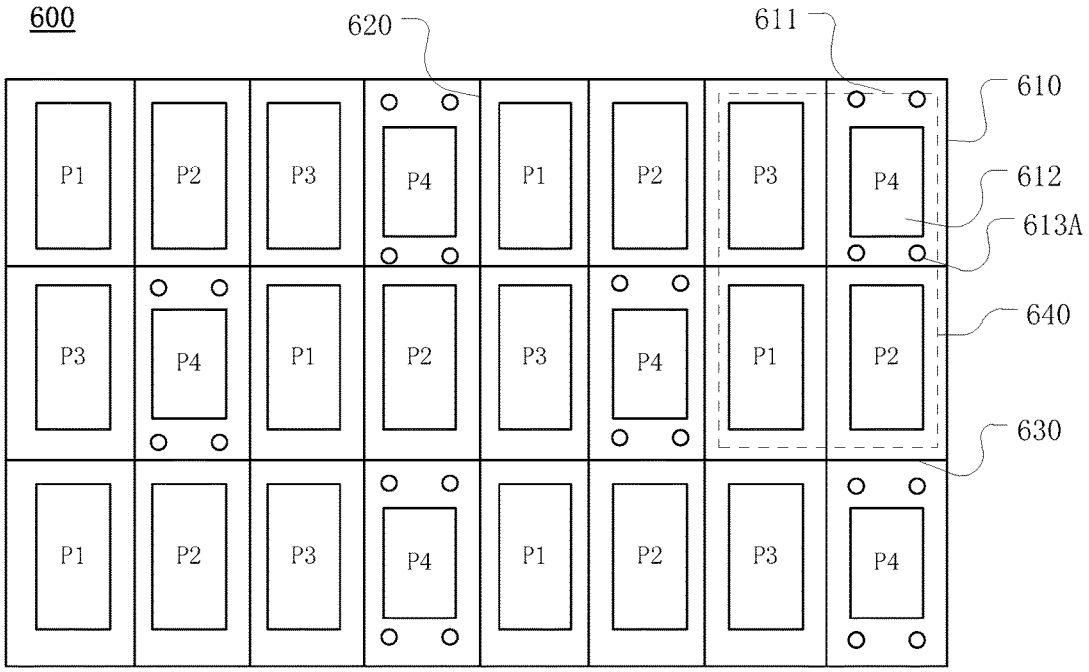
FIG. 10 is a schematic diagram illustrating a display panel according to an embodiment in accordance with the disclosure.

FIG. 10 is a schematic diagram illustrating a display panel 600 according to an embodiment of the present disclosure. The configuration of the display panel 600 as shown in FIG. 10 is similar to the display panel 200 as shown in FIG. 2. Specifically, taking one pixel group 640 as an example, the pixel group 640 includes one first-type sub-pixel P1, one sub-pixel of the second sub-pixel type P2, one sub-pixel of the third sub-pixel type P3 and one sub-pixel of the fourth sub-pixel type P4. In the pixel group 640, the sub-pixels are arranged in a 2*2 matrix. In the pixel group 640, four display elements 613A are disposed within the non-aperture region 611 of the sub-pixel of the fourth sub-pixel type P4. Each display element 613A is a spacer.

Specifically, the four spacers 613A are correspondingly disposed in the non-aperture region 611 of each sub-pixel of the fourth sub-pixel type P4, and each of the four spacers 613A is associated with the corresponding sub-pixel of the fourth sub-pixel type P4. The four spacers 613A within the non-aperture region 611 of each sub-pixel of the fourth sub-pixel type P4 are disposed at a position of the non-aperture region 611 of the sub-pixel of the fourth sub-pixel type P4 which is close to a crossing point of one scan line 630 and one data line 620.

Figure 11:
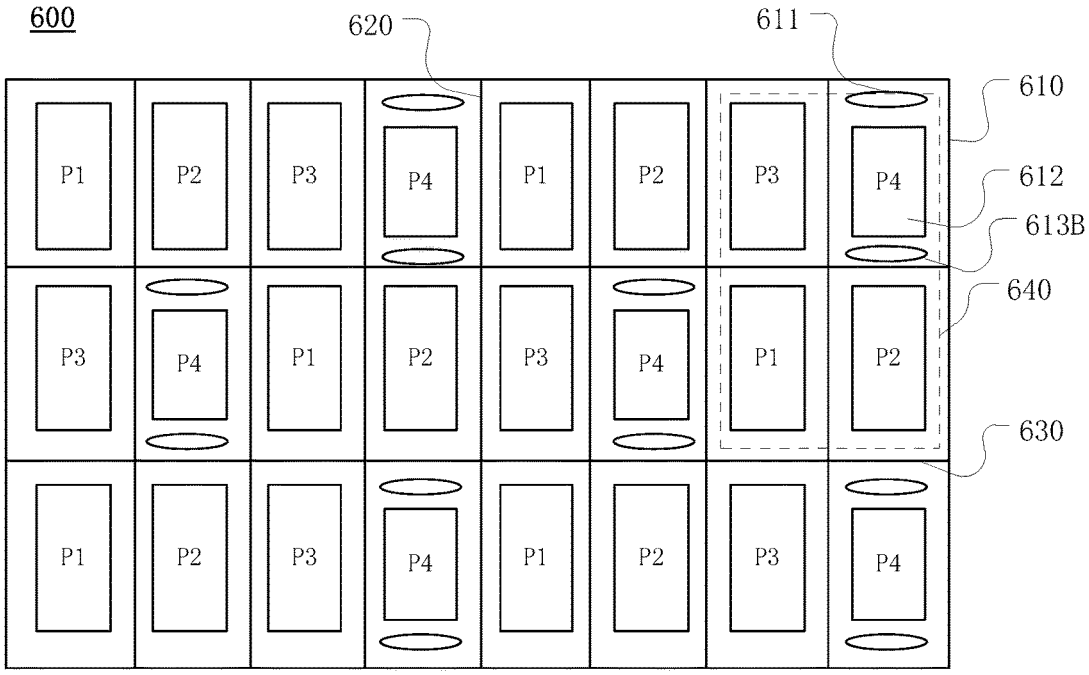
FIG. 11 is a schematic diagram illustrating a display panel according to an embodiment in accordance with the disclosure.

FIG. 11 is a schematic diagram illustrating a display panel 600 according to an embodiment in accordance with the disclosure. The configuration of the display panel 600 as shown in FIG. 11 is similar to the display panel as shown in FIG. 10. Specifically, taking the same pixel group 640 as an example, the pixel group 640 includes one first-type sub-pixel P1, one sub-pixel of the second sub-pixel type P2, one sub-pixel of the third sub-pixel type P3 and one sub-pixel of the fourth sub-pixel type P4. In the pixel group 640, the sub-pixels are arranged in a 2*2 matrix. In the pixel group 640, two display elements 613B are disposed within the non-aperture region 611 of the sub-pixel of the fourth sub-pixel type P4. Each display element 613B is a spacer.

Specifically, the two spacers 613B are correspondingly disposed in the non-aperture region 611 of each sub-pixel of the fourth sub-pixel type P4, and each of the two spacers 613B is associated with the corresponding sub-pixel of the fourth sub-pixel type P4. The two spacers 613B within the non-aperture region 611 of each sub-pixel of the fourth sub-pixel type P4 are disposed at a position of the non-aperture region 611 of the sub-pixel of the fourth sub-pixel type P4 which is at either side of one scan line 630.

FIGS. 10 and 11 only illustrate a pixel group with sub-pixels arranged in a 2*2 matrix. However, the present disclosure is not limited thereto. One skilled in the art may also implement a pixel group with sub-pixels arranged in "T" shape, which will not be elaborated herein.

In the embodiments as shown in FIGS. 10 and 11, the spacers in the pixel group are disposed within the non-aperture region 611 of the sub-pixel of the fourth sub-pixel type P4, such that an area of an aperture region 612 of a sub-pixel of other types may be increased compared with the related art, and thus the aperture ratio of a sub-pixel of other types may be increased.

The embodiments as shown in above FIGS. 3 to 11 only shows an embodiment in which the display element is one of a thin film transistor, a pixel-electrode via hole, a data-line leading hole and a spacer. One skilled in the art may also contemplate embodiments in which the display element is one or more of a thin film transistor, a pixel-electrode via hole, a data-line leading hole and a spacer. These embodiments fall within the protective scope of the present disclosure, and will not be elaborated herein.

In addition, in the embodiments as shown in the above FIGS. 5 to 11, the display element is one of a thin film transistor, a pixel-electrode via hole, a data-line leading hole and a spacer, compared with the embodiment in which a thin film transistor is taken as a display element, the storage capacitance in the sub-pixels may be maintained as balanced.

The above accompanying drawings are merely illustrative, and schematically show the display panel and its components provided by the present disclosure. For the sake of visual brevity, some elements, some films and layers are omitted. One skilled in the art may implement various variants according the description of the present disclosure, for example, by adding some elements or modifying shapes of some elements without departing the essence of the present disclosure. These variants all fall within the protective scope of the present disclosure and will not be elaborated herein.

Figure 12:
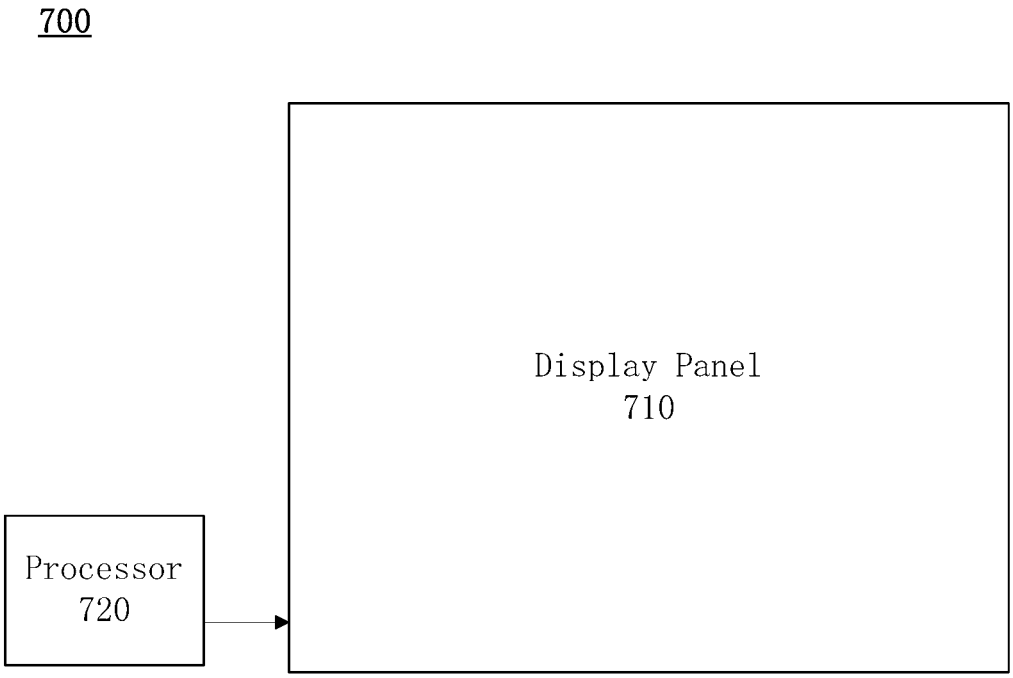
FIG. 12 is schematic diagram illustrating a display device according to an embodiment in accordance with the disclosure.

According to another aspect of the present disclosure, there also provides a display device including the above display panel. As shown in FIG. 12, optionally, the display panel 700 may be integrated with a processor 720 configured to control and process an image displayed on the processor 720, which will not be elaborated herein.

Compared with the related art, in the present disclosure, by making the area of the aperture region of the fourth-type sub-pixel smaller than the area of the aperture region of one sub-pixel of other types, the problem of redundant brightness for the fourth-type sub-pixel may be mitigated. Moreover, in the present disclosure, the display element is disposed within the non-aperture region of the fourth-type sub-pixel to further increase the area of the aperture region of one sub-pixel of the first-type sub-pixels, the sub-pixel of the second sub-pixel types and the sub-pixel of the third sub-pixel types, and the brightness of an image displayed by the first (the second or the third) sub-pixels may be improved.

The exemplary embodiments of the present disclosure has been illustrated and described in detail. It should be understood that the present disclosure is not limited by the embodiment disclosed. Instead, the present disclosure intends to cover all the modifications and equivalent replacements within the scope of the appended claims.

What is claimed is:

1. A display panel, comprising: a plurality of sub-pixels formed by a plurality of scan lines intersecting a plurality of data lines, the plurality of sub-pixels being arranged in a matrix, each of the sub-pixels comprising a pixel electrode, the plurality of sub-pixels being divided into a first sub-pixel type, a second sub-pixel type, a third sub-pixel type and a fourth sub-pixel type, each type of sub-pixels being configured to display a different color, wherein, each sub-pixel of the first-sub-pixel type, the second-sub-pixel type, the third-sub-pixel type and the fourth-sub-pixel type comprises an aperture region allowing light to pass through and a non-aperture region where light cannot pass through, an area of an aperture region of each sub-pixel of the fourth-sub-pixel types is smaller than an area of an aperture region of any sub-pixel of the first-sub-pixel type, the second-sub-pixel type and the third-sub-pixel type, the plurality of sub-pixels are divided into a plurality of pixel groups, each of the pixel groups comprises four of the sub-pixels, one of the four sub-pixels in each of the pixel groups is the fourth sub-pixel type, each of the pixel groups further comprises at least two display elements, each of the display elements is associated with one of the sub-pixels in the pixel group, and the at least two display elements are disposed within the non-aperture region of the fourth sub-pixel type, and each pixel group has a T shape in which a third-type sub-pixel and a first-type sub-pixel are positioned adjacent to a fourth-type sub-pixel in a row direction, a second-type sub-pixel is positioned adjacent to the fourth-type sub-pixel in a column direction, and four thin film transistors for respectively driving the four sub-pixels are disposed in the non-aperture region of the fourth-type sub-pixel, sources and gates of the four thin film transistors are connected to various data lines and scan lines, and drain electrodes of the four thin film transistors are connected to pixel electrodes of the four sub-pixels respectively, wherein the gates of the thin film transistors are in a hollow squared shape, wherein heads of the T shapes of adjacent pixel groups are orientated towards opposite directions; and wherein in each pixel group, each of the display elements is a data-line leading hole; and the source electrode of the thin film transistor is electrically connected to one data line through the data-line leading hole.

2. The display panel of claim 1, wherein the area of the aperture region of each of the fourth-sub-pixel type is larger than or equal to one third of an average area of the aperture regions of a sub-pixel of the first sub-pixel type, a sub-pixel of the second sub-pixel type and a sub-pixel of the third sub-pixel type.

3. The display panel of claim 1, wherein the sub-pixels of the first sub-pixel types, the second sub-pixel type and the third sub-pixel type are respectively one distinct type of red sub-pixels, green sub-pixels and blue sub-pixels, and the sub-pixels of the fourth-sub-pixel type are white sub-pixels or yellow sub-pixels.

4. The display panel of claim 1, wherein the sub-pixels of the fourth-sub-pixel type are disposed as spaced apart from one another by one or more sub-pixels of other types in a row direction and in a column direction of the matrix.

5. The display panel of claim 4, wherein in the row direction of the matrix, a sub-pixel of the first sub-pixel type, one sub-pixel of the second sub-pixel type, one sub-pixel of the third sub-pixel type and a sub-pixel of the fourth sub-pixel type are arranged alternately in such order, sub-pixels of the same type in two adjacent rows are misaligned with each other by two sub-pixels.

6. The display panel of claim 1, wherein in each pixel group, each of the display elements is a pixel-electrode via hole; and the pixel electrode of each sub-pixel in the pixel group is electrically connected to the drain electrode of a thin film transistor through the pixel-electrode via hole.

7. The display panel of claim 1, wherein each of the display elements is a spacer.

8. The display panel of claim 7, wherein four spacers are correspondingly disposed in the non-aperture region of each sub-pixel of the fourth sub-pixel type, and the four spacers within the non-aperture region of each sub-pixel of the fourth sub-pixel type are disposed adjacent to intersection points of the scan lines and the data lines forming the fourth sub-pixel type.

9. The display panel of claim 1, wherein the width-length ratio of each of the sub-pixels is 1:3.

10. A display device, comprising:

a display panel, comprising:

a plurality of sub-pixels formed by a plurality of scan lines intersecting a plurality of data lines, the plurality of sub-pixels being arranged in a matrix, each of the sub-pixels comprising a pixel electrode, the plurality of sub-pixels being divided into a first sub-pixel type, a second sub-pixel type, a third sub-pixel type and a fourth sub-pixel type, each type of sub-pixels being configured to display a different color, wherein, each sub-pixel of the first-sub-pixel type, the second-sub-pixel type, the third-sub-pixel type and the fourth-sub-pixel type comprises an aperture region allowing light to pass through and a non-aperture region where light cannot pass through, an area of an aperture region of each sub-pixel of the fourth-sub-pixel types is smaller than an area of an aperture region of any sub-pixel of the first-sub-pixel type, the second-sub-pixel type and the third-sub-pixel type, the plurality of sub-pixels are divided into a plurality of pixel groups, each of the pixel groups comprises four of the sub-pixels, one of the four sub-pixels in each of the pixel groups is the fourth sub-pixel type, each of the pixel groups further comprises at least two display elements, each of the display elements is associated with one of the sub-pixels in the pixel group, and the at least two display elements are disposed within the non-aperture region of the fourth sub-pixel type, and each pixel group has a T shape in which a third-type sub-pixel and a first-type sub-pixel are positioned adjacent to a fourth-type sub-pixel in a row direction, a second-type sub-pixel is positioned adjacent to the fourth-type sub-pixel in a column direction, and four thin film transistors for respectively driving the four sub-pixels are disposed in the non-aperture region of the fourth-type sub-pixel, sources and gates of the four thin film transistors are connected to various data lines and scan lines, and drain electrodes of the four thin film transistors are connected to pixel electrodes of the four sub-pixels respectively, wherein the gates of the thin film transistors are in a hollow squared shape, wherein heads of the T shapes of adjacent pixel groups are orientated towards opposite directions; and wherein in each pixel group, each of the display elements is a data-line leading hole; and the source electrode of the thin film transistor is electrically connected to one data line through the data-line leading hole.

11. The display device of claim 10, wherein the area of the aperture region of each sub-pixel of the fourth-sub-pixel type is larger than or equal to one third of an average area of the aperture regions of a sub-pixel of the first-type sub-pixel, a sub-pixel of the second sub-pixel type and a sub-pixel of the third sub-pixel type.

12. The display device of claim 10, wherein the first sub-pixel type, the second sub-pixel type and the third sub-pixel type are respectively one distinct type of red sub-pixels, green sub-pixels and blue sub-pixels, and the fourth-sub-pixel type are white sub-pixels or yellow sub-pixels.

13. The display device of claim 10, wherein the fourth-sub-pixel type are disposed as spaced apart from one another by one or more sub-pixels of other types in a row direction and in a column direction.

14. The display device of claim 13, wherein in the row direction of the matrix, a sub-pixel of the first-type sub-pixel, a sub-pixel of the second sub-pixel type, a sub-pixel of the third sub-pixel type and a sub-pixel of the fourth sub-pixel type are arranged alternately in a following order: sub-pixels of the same type in two adjacent rows are misaligned with each other by two sub-pixels.

* * * * *